US006859956B2

(12) United States Patent
Mantyla et al.

(10) Patent No.: US 6,859,956 B2
(45) Date of Patent: Mar. 1, 2005

(54) P-TRAP FOR PLUMBING DRAINAGE SYSTEMS

(75) Inventors: James Mantyla, Barrie (CA); Ron Marsden, Innisfil (CA)

(73) Assignee: Canplas Industries Ltd., Barrie (CA)

( * ) Notice: Subject to any disclaimer, the term of this patent is extended or adjusted under 35 U.S.C. 154(b) by 0 days.

(21) Appl. No.: 10/067,606

(22) Filed: Feb. 5, 2002

(65) Prior Publication Data

US 2002/0116759 A1 Aug. 29, 2002

(30) Foreign Application Priority Data

Feb. 27, 2001 (CA) ..... 2338814

(51) Int. Cl.[7] ..... E03C 1/12

(52) U.S. Cl. ..... 4/679; 4/680; 4/681; 4/695; 4/DIG. 13; 4/DIG. 16; 285/121.7; 285/134.1; 285/146.1; 285/261; 285/271; 137/247.27; 137/247.23

(58) Field of Search ..... 4/679, DIG. 16, 4/DIG. 13, 681, 680, 695; 285/121.7, 134.1, 146.1, 261, 271; 137/247.27, 247.23

(56) References Cited

U.S. PATENT DOCUMENTS

| | | | | | |
|---|---|---|---|---|---|
| 441,691 | A | | 12/1890 | McClellan | |
| 595,577 | A | * | 12/1897 | Moore | 285/179 |
| 739,154 | A | * | 9/1903 | Crawford | |
| 885,256 | A | | 4/1908 | Jones | |
| 1,076,921 | A | * | 10/1913 | Stafford | |
| 1,187,642 | A | | 6/1916 | Milz | |
| 1,347,470 | A | * | 7/1920 | Bard | |
| 1,450,606 | A | * | 4/1923 | Paine | 277/622 |
| 1,475,090 | A | | 11/1923 | Taylor | |
| 1,564,175 | A | | 12/1925 | Hoehn | |
| 1,695,263 | A | | 12/1928 | Jacques | |
| 1,829,101 | A | | 10/1931 | McGeorge | |
| 2,388,633 | A | | 11/1945 | De Woody | |
| 2,564,938 | A | * | 8/1951 | Warren | |
| 3,034,809 | A | | 5/1962 | Greenberg | |
| 3,243,209 | A | | 3/1966 | Chertok | |
| 3,382,508 | A | * | 5/1968 | Kammermeyer | 4/679 |
| 3,459,446 | A | * | 8/1969 | Walsh | 285/362 |
| 3,633,219 | A | * | 1/1972 | Byrd | 137/363 |
| 3,719,209 | A | * | 3/1973 | Rush et al. | 138/177 |
| D231,930 | S | * | 6/1974 | Danks | D23/268 |
| 3,853,339 | A | * | 12/1974 | Wilson | 285/135.4 |
| 3,860,978 | A | * | 1/1975 | Wirth | 4/679 |
| 3,872,521 | A | * | 3/1975 | Friedman | 4/255.01 |

(List continued on next page.)

FOREIGN PATENT DOCUMENTS

| | | | | |
|---|---|---|---|---|
| GB | 2 090 883 A | * | 7/1982 | E03C/1/284 |

*Primary Examiner*—Henry Bennett
*Assistant Examiner*—Nihir Patel
(74) *Attorney, Agent, or Firm*—Hoffmann & Baron LLP

(57) ABSTRACT

A P-trap device for plumbing drainage systems is shown. The device has a first tubing element having a pipe attachment bell at one end and a first coupler portion at the other end and a second tubing element having a pipe attachment bell at one end and a second coupler portion at the other end, wherein said first and second coupler portions are sized and shaped to be coupled together. The device further has at least one of said first or second tubing element being a generally unshaped section sized and shaped to trap water therein. A connector to releasably couple said first and second coupler portions together is included, the connector including a sealing gasket. The sealing gasket, first coupling portion and second coupling portion are sized and shaped to permit the first and second coupler portions to be coupled together over a range of angles to form a leak resistant joint without introducing stresses into the plumbing system. Most preferably the shape of the connecting portions is in the form of male and female matching part spherical sealing surfaces.

18 Claims, 3 Drawing Sheets

U.S. PATENT DOCUMENTS 3,891,246 A 6/1975 Hopper
3,908,208 A * 9/1975 McIlroy ..... 4/679
3,967,324 A * 7/1976 Olive ..... 4/679
4,352,368 A * 10/1982 Landgarten ..... 137/247.45
4,516,278 A * 5/1985 Lamond ..... 4/679
4,618,173 A * 10/1986 Dopyera et al.
4,776,615 A * 10/1988 Young
4,811,431 A * 3/1989 Kraverath
4,840,410 A * 6/1989 Welkey
D346,646 S * 5/1994 Doyle ..... D23/268
5,446,928 A * 9/1995 Daniels ..... 4/434
5,449,206 A 9/1995 Lockwood
5,586,568 A * 12/1996 Helmsderfer ..... 137/15.08
5,649,566 A * 7/1997 Helmsderfer ..... 137/375
5,678,598 A * 10/1997 Helmsderfer ..... 137/375
5,715,550 A * 2/1998 Griffin ..... 4/679
5,865,378 A 2/1999 Hollinshead et al.
5,901,731 A * 5/1999 Traylor ..... 137/15.09
5,904,175 A * 5/1999 Helmsderfer ..... 137/375
6,012,480 A * 1/2000 Helmsderfer ..... 137/375
6,269,495 B1 * 8/2001 Sondrup
6,418,569 B1 * 7/2002 Knight

* cited by examiner

P-TRAP FOR PLUMBING DRAINAGE SYSTEMS

FIELD OF THE INVENTION

This application relates to the plumbing field and more particularly relates to the drainage side of plumbing systems. Most particularly, this application relates to P-traps of the type that are used on drains for sinks, tubs and the like.

BACKGROUND OF THE INVENTION

The plumbing and construction industries have for a long time understood the necessity of employing a trap, to act as a vapour barrier, between an open drain hole in a sink, for example, and a conduit to a sewer system or septic holding tank. Such traps are configured to retain (trap) an amount of water in a U-shaped bend which is sufficient to form the vapour barrier against noxious sewer gases entering into living space through an otherwise open drain. Such gasses are unhealthy and can cause sickness.

A conventional P-trap is formed from generally tubular drain fittings, which may be fabricated from either metal or plastic. A conventional trap is typically formed with the U bend to which is attached, for example, a 90 degree elbow at the outlet leg of the U. This elbow defines a generally horizontal outlet which can then be connected to appropriate drainage tubing which is in turn connected to a sewer or septic system for the disposal of liquid wastes. For P-traps made from plastic fittings the inlet leg of the U is typically solvent welded or frictionally coupled to a drain pipe which may for example extend down from a sink or bathtub drain. Typically between the 90 degree elbow and the U is a joint which may be either a solvent joint, or may be a detachable joint held together by a threaded connector. An example of prior art systems with threaded joints are found in U.S. Pat. Nos. 4,352,368 and 3,719,209. The other outlet end of the elbow is also typically solvent welded to the outflow drainage conduit.

Ideally such a P-trap is installed as follows. First the drain pipe from the sink and the drain conduit connecting the sink to the septic or sewer system are roughed in to an approximate location. The ends of these pipes will be generally in the same area, but not attached. Then the P-trap is installed between the free ends of the two pipes. The P-trap, comprising the elbow and the u shaped tube tightly threaded together, is first solvent welded at one end and then solvent welded at the other end. Then the threaded joint can be undone or relaxed if needed for further manipulation of the pipes.

However, what more typically happens is that the installer positions the P-trap in place between the free ends, and then trims the ends of the pipes to an appropriate length to accept the P-trap there-between. The location of the trap is often very awkward; the pipes may be crammed together under a sink in a vanity cabinet for example. So, typically, the installer will undo the threaded connection, and then solvent cement or glue or solvent weld, individually, the separated elbow and the u-shaped tube to respective free ends of the pipes. Then, the installer uses the threaded connector to draw the two components into a sealing relationship. While easy, this method is problematic. It is very difficult to ensure the two fittings are both attached perfectly in the same plane. Further because they are separated at the time they are attached, it is difficult to ensure that the ends are sufficiently close to permit the connector to easily couple the two ends together.

As a result it can be difficult to make a leakproof joint at the connection between the U-bend and the 90 degree elbow, because to do so requires precise positioning of the two solvent welded fittings relative to one another at a time when they are separated. According to preferred procedures, the threaded connection should be made tight between the elbow and the U-shaped bend before welding the components in place. However, where the elbow and U-shaped pipe are disconnected and each independently solvent welded onto their respective drain pipe connections misalignment usually occurs. The threaded coupler can compensate slightly for misalignment because of the compression provided by the threaded coupler onto a seal and the slight resiliency of a plastic pipe system. To rely on the inherent resiliency of the pipe system however essentially introduces a strain into the system. A P-trap joint which is under pressure may not seal properly or worse, it may seem sealed but over time due to the strain introduced by misalignment may fail at a later date. Alternatively, if the misalignment is large, the pressure generated by the threaded coupler as the components are clamped together can be enough to cause a cracking or opening of other drain pipe connections in the piping system.

Various types of couplings and connectors exist in the art, including the following:

U.S. Pat. No. 5,865,378 to Hollinshead et al;

U.S. Pat. No. 5,449,206 to Lockwood;

U.S. Pat. No. 3,891,246 to Hopper;

U.S. Pat. No. 3,243,209 to Chertok;

U.S. Pat. No. 3,034,809 to Greenberg;

U.S. Pat. No. 2,388,633 to Woody;

U.S. Pat. No. 1,829,101 to McGeorge;

U.S. Pat. No. 1,695,263 to Jacques;

U.S. Pat. No. 1,564,175 to Hoehn;

U.S. Pat. No. 1,475,090 to Taylor;

U.S. Pat. No. 1,187,642 to Milz;

U.S. Pat. No. 885,256 to Jones; and

U.S. Pat. No. 441,691 to McClellan.

What is required, therefore, is a P-trap assembly which couples or connects to form a good liquid tight seal even when the components are slightly out of alignment without creating unacceptable stresses in either the P-trap assembly or any other part of the plumbing system.

SUMMARY OF THE INVENTION

The present invention provides a coupler which is easy to install and forms a secure joint. The coupler includes a connector with a seal which can be used to connect together the 90 degree elbow and the U-shaped fitting. First and second connector portions of the device are configured so that they may be securable across a range of angles. This provides a leakproof joint which can accommodate small variances in alignment such as typically occur in the field. Therefore, according to the present invention there is provided a device for plumbing drainage systems said device comprising:

a first tubing element having an attachment bell at one end and a first coupler portion at the other end;

a second tubing element having an attachment bell at one end and a second coupler portion at the other end, wherein said first and second coupler portions are sized and shaped to be coupled together; and at least one of said first or second tubing element is a generally unshaped section sized and shaped to trap water therein; and a connector to releasably couple said first and second coupler portions together, said connector including a sealing gasket, said sealing gasket, first coupling portion and second coupling portion being sized and shaped to permit said first and second coupler portions to be coupled together over a range of angles to form a leak resistant joint.

According to a further aspect there is provided a device for plumbing drainage systems, said device comprising:

a first tubing element having an attachment bell at one end and a first coupler portion at the other end;

a second tubing element having an attachment bell at one end and a second coupler portion at the other end, at least one of said first and second tubing elements being generally U-shaped and sized and shaped to trap water therein;

wherein said first and second coupler portions are sized and shaped to permit said first and second coupler portions to be snapped together over a range of angles to form a leak resistant joint.

BRIEF DESCRIPTION OF THE DRAWINGS

Reference will now be made to preferred embodiments of the invention by way of example only with reference to the following figures.

DETAILED DESCRIPTION OF THE PREFERRED EMBODIMENTS

Figure 1:
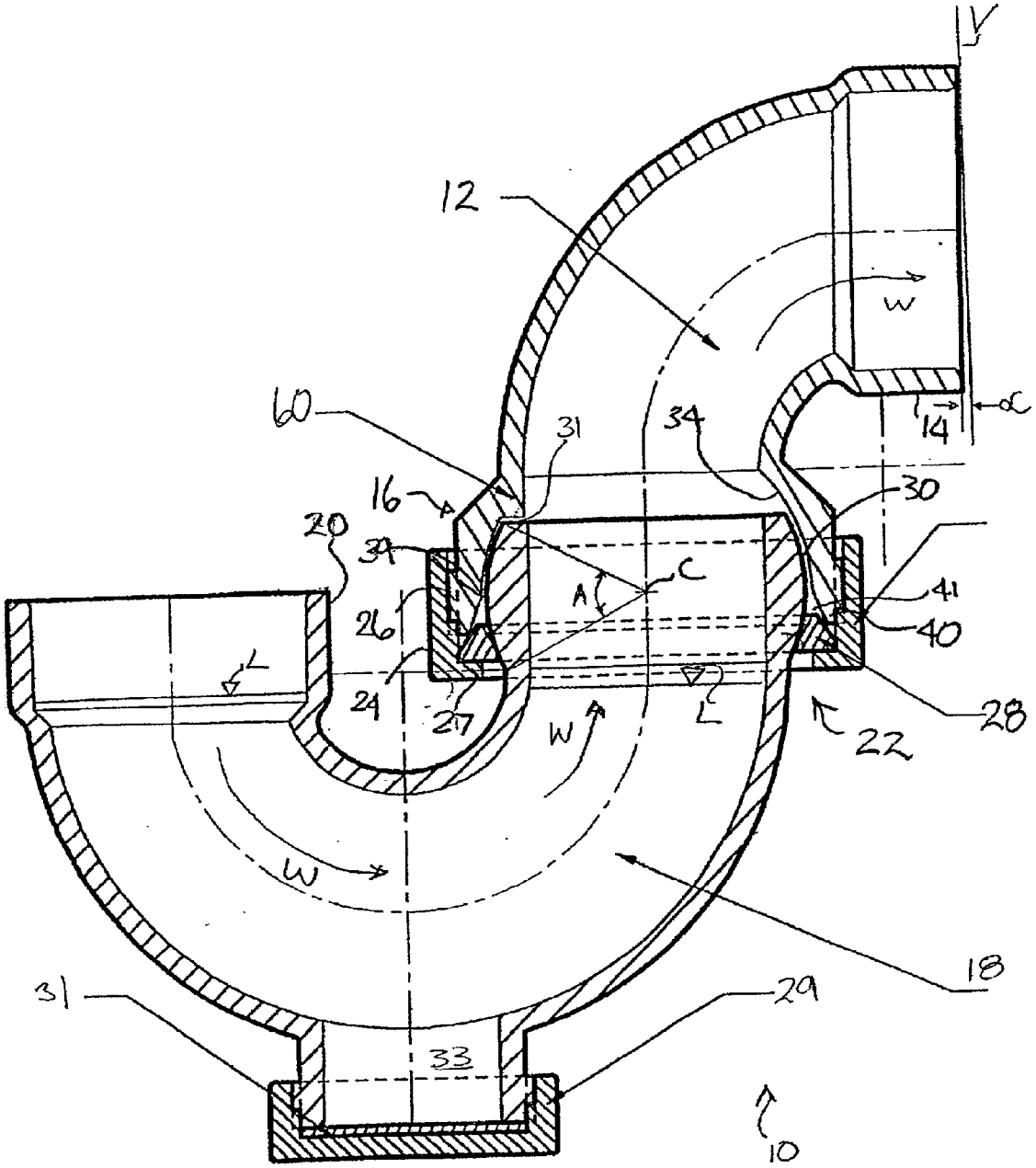
FIG. 1 is a cross-section of U of a device for plumbing drainage systems according to the present invention comprised of an elbow and a U-shaped bend.

A device for plumbing and drainage systems according to the present is indicated generally as 10 in FIG. 1. The device includes a first tubing element 12 having an attachment bell 14 and a first coupler portion 16 at the other end. The tubing element 12 is in the form of a 90 degree elbow. Also shown is a second tubing element 18 having an attachment bell 20 at one end and a second coupler portion 22 at the other end. The second tubing element 18 is in the form of a U-shaped tube. The u-shape is sufficient in size and shape to retain water therein to form a vapour barrier when the device 10 is installed in a drainage system. A connector 24 is shown having threads 26 to allow the connector to be releasably secured to the device 10 as described below and also has an inwardly extending rim 27. Also shown is a seal 28 which is described in more detail below.

Also shown in FIG. 1 is a threaded clean out cap 29, a clean out gasket 31 on a clean out port 33. Waste flow is indicated by the arrows W and the liquid trap level is shown by lines L.

Figure 2:
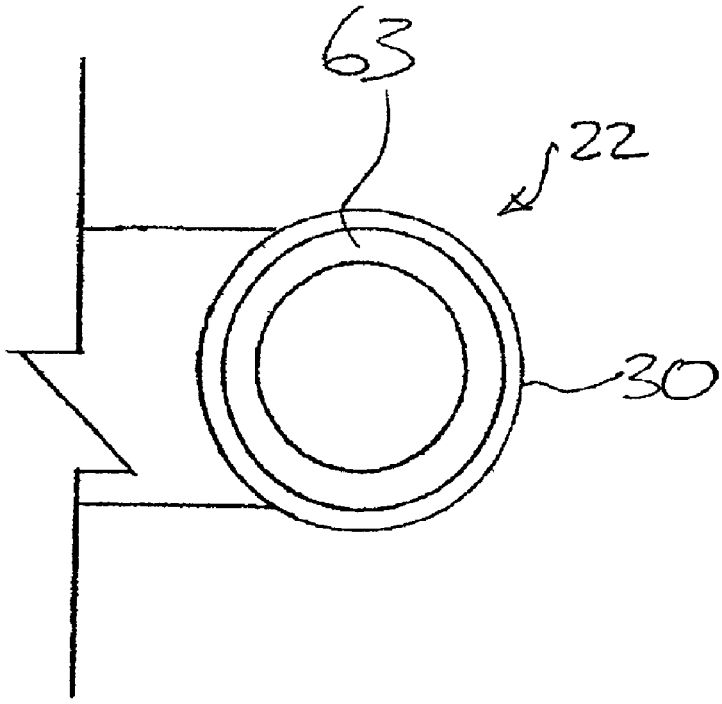
FIG. 2 is a view from above of one of the components from FIG. 1.

Referring to the first coupler portion 16 in more detail, it can be seen that in cross-section it is formed with a generally rounded outer surface 30. Most preferably the generally rounded outer surface 30 is part spherical with a center (C) located on the axial centerline of the tubing element and about midway down the connector portion 22 as shown. This forms the male portion of the connection. It will be appreciated by those skilled in the art that other centre points can be used and even that the surface need not be a perfect part spherical section, but good results have been achieve with a part spherical section as shown. As will also be appreciated the part spherical section extends fully around the tubing element similar to a conventional flange as shown in FIG. 2. This part spherical section is described below as a bulb or ball. Most preferably this surface will be sufficiently smooth to permit a seal to be formed there-against. Good results have been obtained by providing a surface smoothness SPE #2 finish.

Referring now to the second coupler portion 22, it can be seen as having part spherical inside surface 34 or socket or female part to closely receive the outside ball shaped surface 30 described above. Again most preferably the inside surface 34 is part spherical so that it matches the bulb portion when the bulb is inserted in the socket. Again the inside surface is also preferable of a smoothness to permit a good liquid tight seal to be formed there-against.

As can be seen, the inside surface is curved or dished to an inflection point 39 after which the surface extends away from a centerline to form an angled lower lip 40. The angled lip 40 defines a wedge shaped gap 41 in cross section, between the lip 40 and the outer rounded surface 30 of the male part when the male and female parts are assembled together. This wedge shaped gap 41 is important in forming a liquid tight seal as explained in more detail below.

Figure 3:
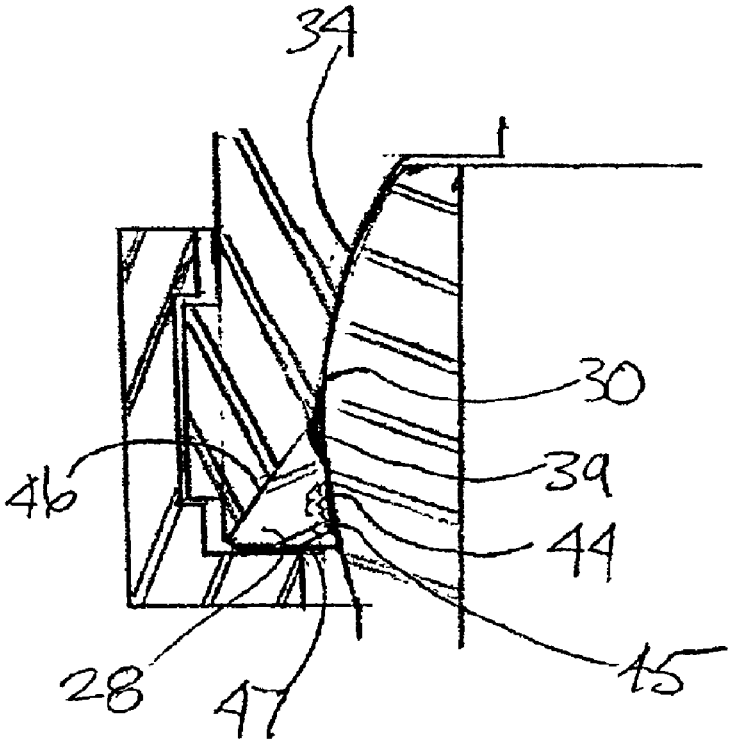
FIG. 3 is an enlarged view of a portion of FIG. 1 showing details of the connection between the two fittings.

FIG. 3 shows an enlarged view of the coupler portions 16 and 22 of FIG. 1. Referring now to the seal 28, most preferably the seal 28 is in the form of a generally wedge-shaped gasket in cross-section having an internal sealing face 44, an external sealing face 46 and a bottom face 47. Most preferably the gasket is in the form of a continuous ring when viewed from above. The internal sealing face 44 must closely match the part spherical surface 30 of the bulb or male part to form a good seal. Matching of the surfaces can be accomplished by making the seal 28 from a partially compressible material which will conform to the outer surface shape 30 or by making the sealing gasket 28 from a less compressible material which is shaped to have a matching curvature to that of the outer surface 30. As will be appreciated by those skilled in the art the sealing could also be effected by using a combination of compression and shaping of the seal 28. Good results have been achieved to date with the former approach through the use of a molded linear low density polyethylene seal 28 which is shaped with a surface which matches the outer surface 30 closely enough to be easily sealable there-against under a moderate compressive force. This is shown at 45 in FIG. 3.

Turning now to the outer face 46 of the seal 28, this is most preferably conical with the face 46 having a pitch to match the angled portion of the lip 40. The purpose of the face 46 is to translate axial forces (those parallel to the central axis of the pipe) exerted on the seal as the threaded connector is drawn into compressive engagement, into radially compressive forces to cause a good seal between the surface 30 and the sealing face 44. Again most preferably the lip 40 and the outer face 46 should be smooth enough to allow a good seal and to also allow the seal 28 to slip past the lip 40 while device is being tightened together as explained in more detail below.

The bottom face 47 is most preferably flat, and acts as a driving or thrust surface for rim 27 of the threaded connector.

It can now be appreciated how the present invention operates. To assemble the device, the seal 28 is inserted into the connector 24 which in turn is positioned around the u-shaped tube just below the bulb. Then, the elbow 12 is brought close enough to permit the threads of the connector to engage the threads of the elbow. As the connector 24 is threaded on to the second tubing element, it will draw the elbow 12 down onto the u-shaped tube. This will have cause the outer surface 30 to move closer to the inner surface 34. As well, the seal 28 will be compressed into an ever smaller wedge shaped gap 41 as the parts come together and as the rim 27 drives the bottom edge 47 of the seal 28 higher than the gap 41. The seal will be urged into the gap 41 by the rim 25 acting on the surface 47 of the seal 28 causing the seal 28 to compress against both the part spherical surface 30 and the angled surface 42. In this way the seal can be compressed to form a leakproof joint between the two elements 12 and 18.

It can now be appreciated that the choice of linear low density polyethylene, which has a relatively low fictional coefficient is an advantage, since this will lower the resistance to turning the connector 24 on as the seal 28 engages in the wedge shaped gap 41. The rim 27 slips past the thrust face 47 of the seal 28 during final tightening.

It can now be appreciated that by reason of the part spherical surface 30 it is possible to form a liquid tight seal even though the respective elements 12 and 18 may be out of angular alignment. All that is required is for the part spherical surface to extend over a sufficient vertical radial arc to permit the seal to be lower at one point and higher at another point while still forming a good seal fully around the circumference of the tubing elements. Thus, because of the part spherical surface, the seal will be formed tight and continuous even though variations in angle may be present between the two components. Further, the seal so formed will not impose any stresses onto the plumbing connections by reason of any forced alignment as occurs with the prior art devices. Thus, once the seal of the present invention is formed, it will tend to keep its integrity over time and there is also likely to be less collateral damage to other parts of the installed plumbing system.

It can now be appreciated that the range of angular variation is defined by the extent of the part spherical surfaces 30 and 34. Although more is preferred than less, to give a greater range of sealing angles, adequate results have been achieved where the arc angle subtended (shown as A) between the top and bottom of the part spherical surface is between 20° and 90°, and most preferably between 30° and 50°. As shown, the subtended arc angle is about 45°.

Returning now to the shape of the internal surface 44 of the seal 28 it will be noted that the seal will be driven by the rim 27 into engagement with the part spherical surface. One preferred shape for the seal surface is therefore also a part spherical surface which has the same radius of curvature as the male part. Other shapes can be used, provided that the material chosen for the seal is compressible enough to seal against the rounded surface. As will be appreciated, most compressible materials tend to have higher coefficients of friction which is why the more closely shaped, less compressible, low friction properties of low density plastic such as polyethylene is believed the most preferred.

Figure 4:
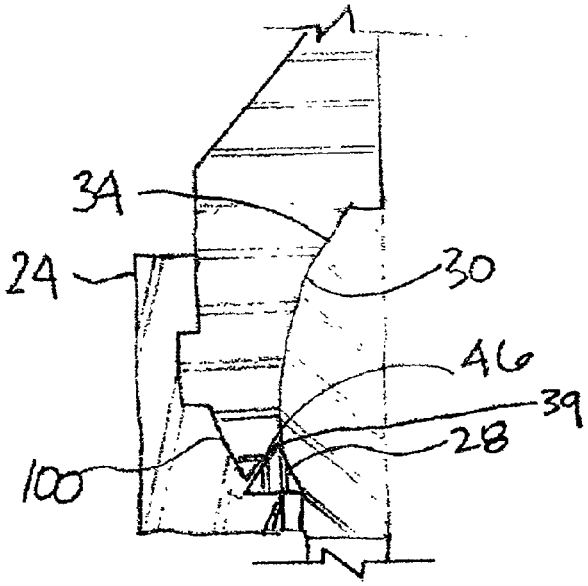
FIG. 4 is a side sectional view of a further embodiment of the present invention.

In a further embodiment shown in FIG. 4, a bevel surface 100 is provided on the threaded connector 24. Thus, as the connector 24 is tightened, the bevel causes a side thrust forcing the seal 28 to engage even more tightly. Further, rather than being a separate component, the seal 28 could be made integral with either the connector on the female portion of the joint.

While reference has been made to a particular form of sealing element, it will be understood that the present invention comprehends other forms of sealing element. For example in FIG. 5, an O-ring 110 type of sealing element is shown. In this embodiment a groove 112 is formed into the female portion. That the O-ring could be equally mounted into the part spherical surface is also comprehended by the present invention. As will be understood, the shape of the seal and the type of seal are less important than the location of the seal. The angular possibilities of connection of the present invention are achieved by sealing against a rounded or part spherical surface. Angular variations in the connection between the elements therefore do not affect the ability to form a seal, unlike in the prior art.

A further aspect of the present invention can now be understood. According to most building codes, all drainage plumbing must be sloped or inclined so that the drainage pipes drain towards the sewer to transport waste out of the building or dwelling. This ensures that the waste does not sit in the pipes and thus reaches and can be treated in an appropriate sewage or wastewater treatment facility. Thus, there is a need to establish, in domestic or other building plumbing a desired fall of the drainage pipe when it is first positioned in the building.

The present invention provides for an automatic provision of a desired amount of minimum fall through the fitting. This is accomplished by means of a stop 60 in the socket or female connector portion. The stop 60 is sized and shaped so that it engages an upper edge or lip 63 of the u-shaped tube 18. Further the stop is sized and shaped to provide that when the stop 60 is in contact with the lip 63 of the u-shaped portion the fitting element 18 is angled slightly down to a predetermined angle or fall. This is depicted by the angle alpha which is formed between vertical (shown as V) and a line connecting the end of the attachment bell 14. Good results have been achieved when the angle so formed is at least one to three degrees and most preferably is about 1 degree. This angle will cause the part 18 to be angled downwardly thus permitting the device to be installed in a position which promotes the flow or drainage of waste from the fitting and from any piping axially connected to the fitting. It is preferred to position the stop on the opposite side of the fitting 12 from the outflow. In this manner the stop permits the fitting to be installed with an angle greater than 1° but prevents the fitting from being installed at an angle of less than 1°. In this way, the stop prevents the fitting 12 from being installed horizontal, or with an uphill rise on the outflow end. Thus, because the fitting is so angled, any pipe plumbed into the fitting will also have the desired fall already established. In this way use of the present invention promotes proper sloping of the drainage plumbing.

Figure 5:
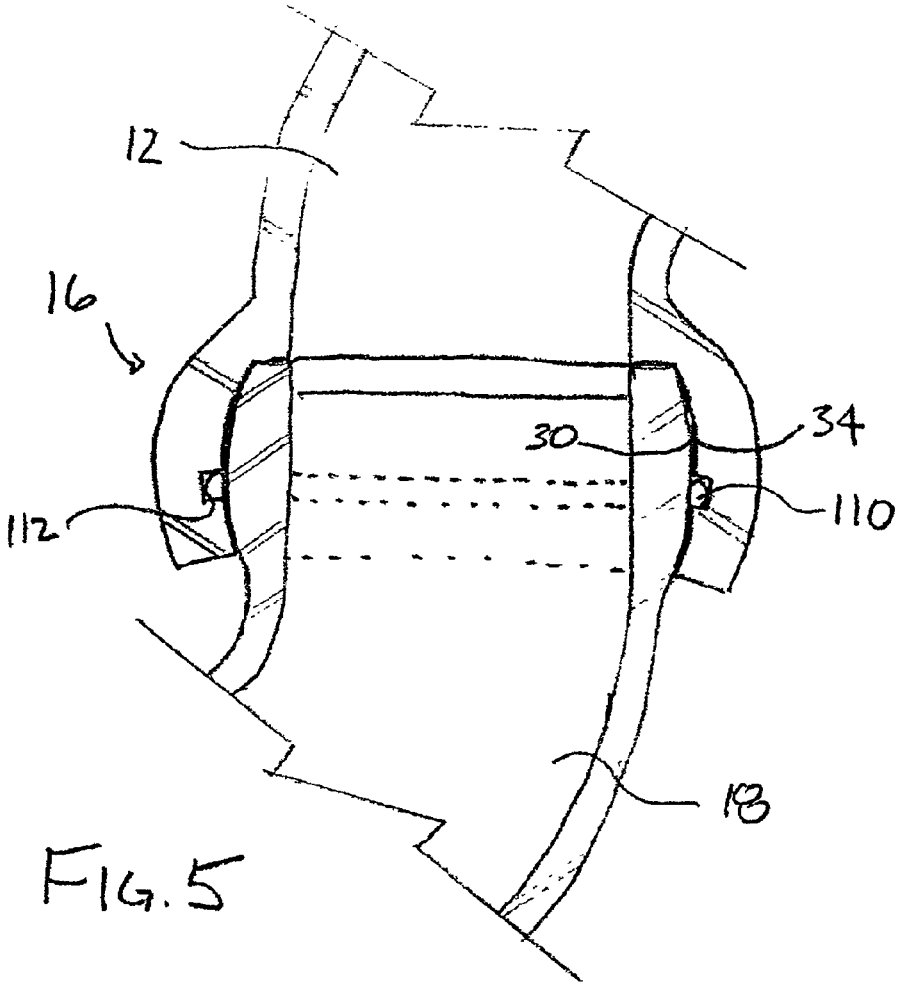
FIG. 5 is a side view of a further embodiment of the present invention.

FIG. 5 teaches a further embodiment of the present invention. In this embodiment there is no connector per se, rather, the female portion 16 is sized and shaped to be resiliently snapped over the male portion. A sealing ring 110, such as an O-ring in a groove 112, is pressed into engagement between the two parts to form a seal. This embodiment is somewhat simpler, but does not include a positive lock between the two parts which may not be preferred in some cases.

While reference has been made to preferred embodiments of the present invention, various modifications and alterations are contemplated and comprehended by the scope of the appended claims. Some of the modifications have been discussed above and other will be apparent to those skilled in the art. For example, while the preferred seal material is low density polyethylene, other seal materials could be substituted therefor without much difficulty. Further, while the preferred size and position of the stop results in a 1° slope, more could be provided if desired.

We claim:

1. A device for plumbing drainage systems said device comprising:

a first tubing element having an attachment bell at one end and a first coupler portion at the other end;

a second tubing element having an attachment bell at one end and a second coupler portion at the other end, wherein said first and second coupler portions are sized and shaped to be coupled together; and at least one of said first or second tubing element is a generally u-shaped section sized and shaped to trap water therein;

a seal sized and shaped to fit between said first coupler portion and said second coupler portion, said seal being sufficiently flexible to form a liquid tight seal; and, a connector to releasably couple said first and second coupler portions together, and to seat said seal between said first and second coupler portions, wherein said first coupler portion and said second coupler portion are sized and shaped to permit said first and second coupler portions to be coupled together over a range of angles to form a leak resistant joint.

2. The device of claim 1 further including an angle stop, for limiting said range of angles, said stop being sized, shaped and positioned to prevent coupling which creates an uphill rise to a downstream element of said first and second tubing elements to promote drainage.

3. The device of claims 1 wherein one of said first and second coupler portions comprises a bulb and the other of said first and second coupler portions comprises a socket sized so that said bulb may be closely received within said socket, said seal being sized and shaped to be inserted between said bulb and socket to form a liquid tight seal.

4. The device of claim 3 wherein said bulb includes a part spherical outer surface.

5. The device of claim 4 wherein said coupling portion defines a tubular section for the passage of waste therethrough and said part spherical outer surface has a center of curvature located approximately on an axial centerline of said first or second tubing element.

6. The device of claim 5 wherein said part spherical section subtends an arc of between about 30° and 60° in a vertical plane.

7. The device of claim 1 wherein said connector may be tightened onto said coupler portions, said connector acting on said seal to form a leak resistant joint.

8. The device of claims 1 wherein said seal is in the form of a ring which is generally wedge shaped in cross section and which has an inner seal surface, an outer seal surface and a bottom thrust face.

9. The device of claim 8 wherein said outer seal surface is generally conical.

10. The device of claim 8 wherein said inner seal surface is sufficiently compressible to become part spherical.

11. The device of claim 8 wherein said bottom thrust face is generally planar.

12. The device of claim 8 wherein said seal is molded from a plastic material.

13. The device of claim 8 wherein said seal is formed from a material which is at least partially compressible to form a liquid tight seal.

14. The device of claim 12 wherein said seal is made from molded low density polyethylene.

15. The device of claim 1 wherein said first coupler portion and said second coupler portion define a generally wedge shaped gap therebetween and said seal is sized and shaped to be received in said wedge shaped gap.

16. The device of claim 15 wherein said connector is threaded onto one of said first and second coupler portions and includes a rim, said rim comprising a thrust surface for thrusting said seal into said wedge shaped gap.

17. A device as claimed in claim 1 wherein one of said first and second coupler portions is a female part having a part spherical inner surface, and the other of said coupler portions is a male part having a part spherical outer surface.

18. A device for plumbing drainage systems, said device comprising:

a first tubing element having an attachment bell at one end and a first coupler portion at the other end;

a second tubing element having an attachment bell at one end and a second coupler portion at the other end, wherein said first and second coupler portions are sized and shaped to be coupled together over a range of angles to form a leak resistant joint; and at least one of said first or second tubing element is a generally u-shaped section sized and shaped to trap water therein;

a seal sized and shaped to fit between said first coupler portion and said second coupler portion, said seal being sufficiently flexible to form a liquid tight seal; and, a connector to releasably couple said first and second coupler portions together, and to seat said seal between said first and second coupler portions;

wherein integrally part of said first or second coupler portions is an angle stop, for limiting said range of angles, to prevent coupling which creates an uphill rise to a downstream element of said first and second tubing elements.

* * * * *

UNITED STATES PATENT AND TRADEMARK OFFICE

CERTIFICATE OF CORRECTION

PATENT NO. : 6,859,956 B2
DATED : March 1, 2005
INVENTOR(S) : James Mantyla and Ron Marsden It is certified that error appears in the above-identified patent and that said Letters Patent is hereby corrected as shown below:

Title page,
Item [57], ABSTRACT,
Lines 8-9, delete “generally unshaped section” and insert -- generally u-shaped section --.

Column 2,
Line 66, delete “generally unshaped section” and insert -- generally u-shaped section --.

Column 4,
Line 2, delete “have been achieve with a” and insert -- have been achieved with a --.

Signed and Sealed this

Nineteenth Day of July, 2005

JON W. DUDAS
*Director of the United States Patent and Trademark Office*